US008479331B2

(12) United States Patent
Craighead

(10) Patent No.: US 8,479,331 B2
(45) Date of Patent: Jul. 9, 2013

(54) MATTRESS MOUNT GUN HOLSTER

(75) Inventor: Matthew Craighead, Springfield, MO (US)

(73) Assignee: Crossbreed Holsters, LLC, Republic, MO (US)

( * ) Notice: Subject to any disclaimer, the term of this patent is extended or adjusted under 35 U.S.C. 154(b) by 614 days.

(21) Appl. No.: 12/647,680

(22) Filed: Dec. 28, 2009

(65) Prior Publication Data

US 2011/0155775 A1 Jun. 30, 2011

(51) Int. Cl.
*A47C 21/00* (2006.01)
*A47C 31/00* (2006.01)

(52) U.S. Cl.
USPC ..... 5/503.1; 5/658; 5/659

(58) Field of Classification Search
USPC ..... 5/503.1, 658, 659
See application file for complete search history.

(56) References Cited

U.S. PATENT DOCUMENTS

| | | | | |
|---|---|---|---|---|
| 4,483,501 | A * | 11/1984 | Eddy | 5/503.1 |
| 4,521,930 | A * | 6/1985 | Henson | 5/503.1 |
| 5,916,087 | A * | 6/1999 | Owens | 5/503.1 |
| 8,074,477 | B1 * | 12/2011 | Weiche | 5/503.1 |
| 8,177,065 | B1 * | 5/2012 | Thomas | 5/503.1 |
| 2002/0018601 | A1 * | 2/2002 | Nelson | 5/503.1 |
| 2011/0132943 | A1 * | 6/2011 | Edelman | 224/243 |
| 2011/0272539 | A1 * | 11/2011 | Yagi | 248/205.2 |

* cited by examiner

*Primary Examiner* — Robert G Santos
*Assistant Examiner* — David E Sosnowski
(74) *Attorney, Agent, or Firm* — Lathrop & Gage LLP

(57) ABSTRACT

A mattress mount gun holster is described for storing a firearm adjacent to a mattress for easy access by the occupant of the mattress. The mattress mount gun holster may be removed from the mattress and stored in a flat configuration during travel or when not in use.

2 Claims, 6 Drawing Sheets

MATTRESS MOUNT GUN HOLSTER

BACKGROUND

1. Field of the Invention

The mattress mount gun holster described herein is a holster for holding a firearm, pepper spray, or any other item so desired by the user, adjacent to a bed for easy access to the occupant of the bed in case of emergency. The mattress mount gun holster is secured to the bed by an insert slid between the mattress and the bed frame or box springs. The mattress mount gun holster described herein may be removed from the bed and stored flat for easy storage and transportation during travel.

2. Description of the Related Art

Gun holsters are known for mounting to a bed. Specifically, mattress mounts are known with an insert for sliding between the mattress and the box spring or other support below the mattress, and a holster attached to the mattress insert, or to a holster support attached to the mattress insert.

Typically, mattress mount gun holsters are devices with a fixed configuration of the mattress insert attached to a perpendicular holster support. The fixed configuration makes these holsters difficult to transport thus substantially confining their use to the home of their owner. It is desirable to be able to take such a mattress mount gun holster on travel for use in hotels or other accommodations.

SUMMARY OF THE INVENTION

The mattress mount gun holster described herein provides a mattress mount gun holster that may be removed from the mattress and disposed in a substantially flat configuration. This allows the mattress mount gun holster to be conveniently packed in luggage and taken on business or personal trips for use.

DETAILED DESCRIPTION

The mattress mount gun holster described herein provides a simple device that securely holds a variety of firearms adjacent to a bed, allowing the user quick and easy access to a firearm from bed in case of emergency. The mattress mount gun holster described herein can also be stored in a flat configuration for travel or storage.

Figure 1:
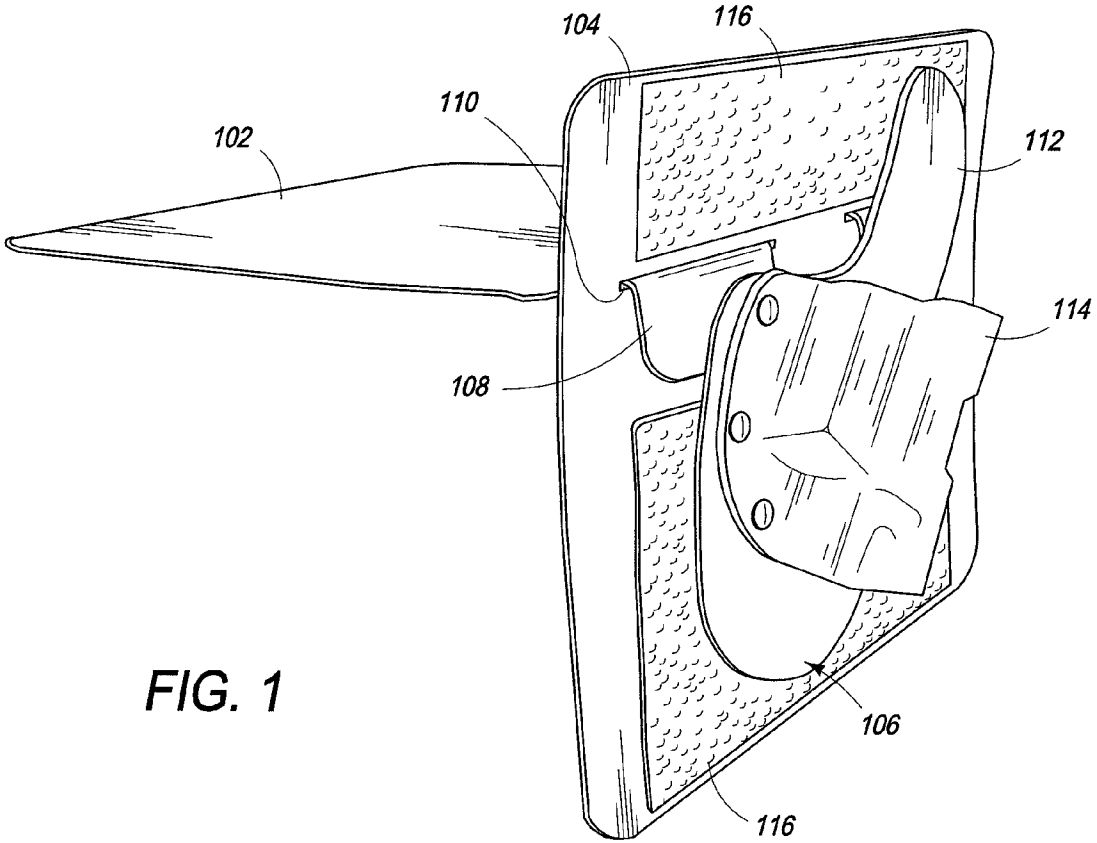
FIG. 1 is a perspective view of an embodiment of the mattress mount gun holster.
Figure 2:
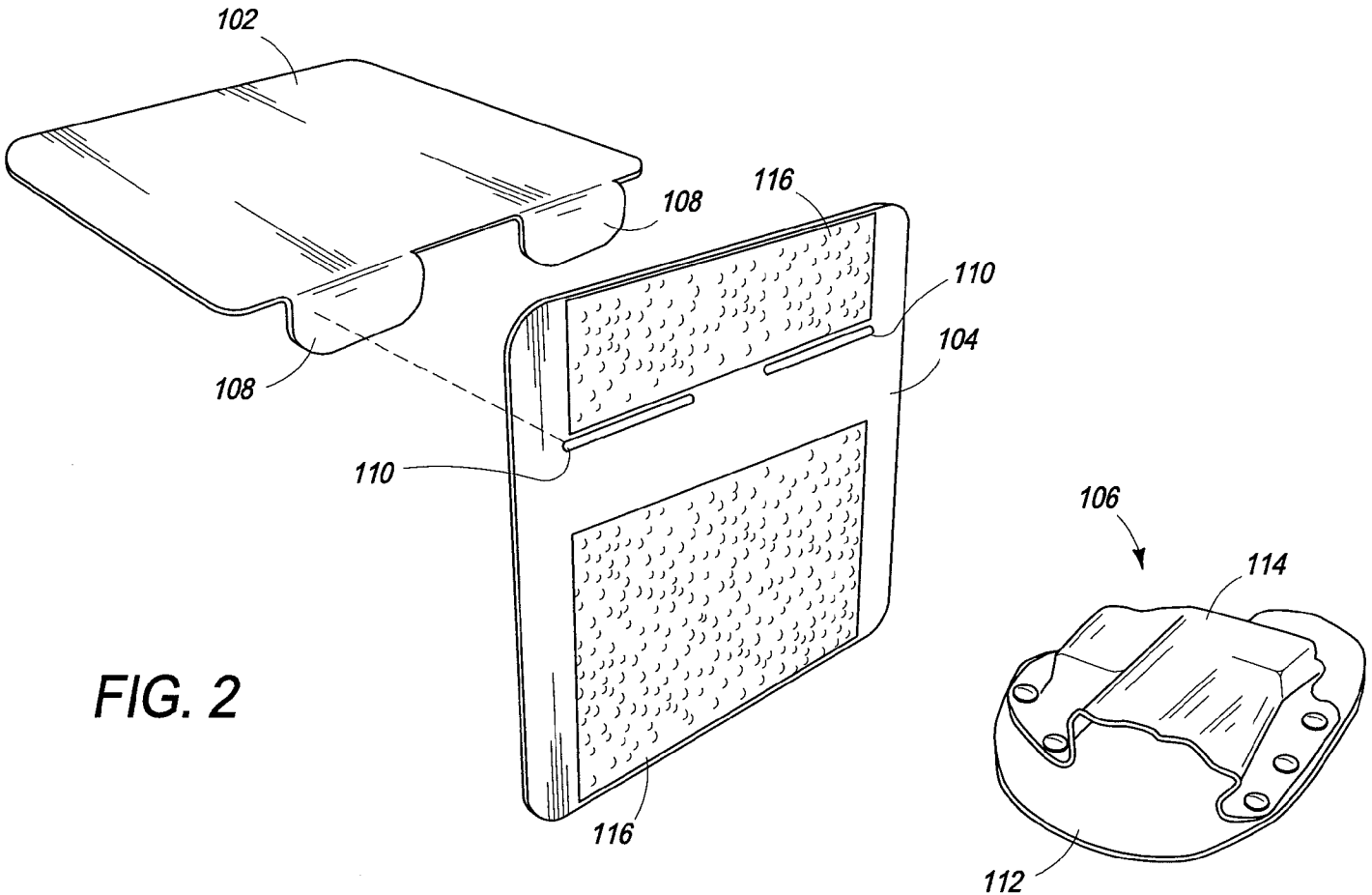
FIG. 2 is an exploded view of an embodiment of the mattress mount gun holster.

Referring now to FIGS. 1 and 2, a perspective view of an embodiment of the mattress mount gun holster is depicted. The mattress mount gun holster 100 comprises a mattress insert member 102, a holster support member 104 and a holster member 106. The holster member 100 is depicted in a configuration ready for use to hold a firearm adjacent to a bed.

The mattress insert member 102 comprises a sheet of rigid material for inserting between a mattress and box spring, or underneath a mattress for securing the holster 100 to the bed. In the depicted embodiment, the mattress insert member 102 is substantially rectangular, although other shapes may be utilized for the insert member 102. The member 102 is formed from a sheet material and in various embodiments may vary in thickness, but should be sufficiently thin to be inserted underneath a mattress without causing a noticeable deformation in the top surface of the mattress. The member 102 may be formed from a variety of materials, including plastic, metal, wood or other similar materials that are light and rigid when formed into a thin sheet.

On a first edge of the mattress insert member 102 is a means for securing the member 102 to the holster support member 104. In the embodiment depicted in FIG. 1, the means for securing the member 102 to the holster support member 104 comprise two rigid tabs 108 oriented substantially perpendicular to the mattress insert member 102. These tabs are received by slots in the holster support member 104, described more fully below.

Alternative means of securing the mattress insert member 102 to the holster support member 104 include hinges, snaps, hook and loop materials, and other quick release fasteners such as quarter turn fasteners or Dzus fasteners. The preferred means of securing the mattress insert member 102 to the holster support member 104 either allow the pivoting of the two members 102 and 104 so that they are flat against one another in a collapsed configuration or permit the easy disconnection of the two members 102 and 104 when not in use so that they can be store flat against one another.

The holster support member 104 comprises a rigid sheet of material similar to the mattress insert member 102. When in use the holster support member 104 is oriented vertically with a top and bottom edge, and a first side disposed against the side of the mattress and box spring or other bed element. The gun holster member 106 is attached to a second side of the holster support member 104. The holster support member 104 has means for securing the holster support member 104 to mattress insert member 102.

In a preferred embodiment of the holster 100, the securing means are located on the side of holster support 104 between the top edge and the bottom edge thereof. Preferably, the securing means are located nearer to the top edge than to the bottom edge of the holster support member 104.

As described above with reference to the mattress insert member 102, a variety of means for securing the member 102 to the holster support member 104 may be utilized in the mattress mount gun holster 100. In an embodiment of the mattress mount gun holster 100, the holster support member 104 is provided with two slots 110 disposed parallel to the top edge of the member 104 and located about one quarter of the distance between the top and bottom edges thereof. The slots 110 are sized and located on the holster support member 104 to accept the rigid tabs 108.

In this embodiment, the mattress insert member 102 is secured to the holster support member 104 by positioning the member 102 substantially parallel to the support member 104, and inserting the rigid tabs 108 into slots 110 until a first side of the mattress insert member 102 is in contact with the first side of the holster support member 104. In this position the rigid tabs 108 extend through slots 110 and substantially perpendicular to the second side of the holster support member 104. The two members 102 and 104 are then pivoted with respect to one another until rigid tabs 108 are substantially parallel to and in contact with the second side of the holster support member 104.

In the embodiment shown in the figures, rigid tabs 108 extend from the slots 110 toward the bottom edge of holster support member 104, although in other embodiments the rigid tabs may extend toward the top edge of the holster support member 104.

After the mattress insert member 102 is secured to the holster support member 104, a holster member 106 is provided and attached to the holster support member 104. In some embodiments of the mattress mount gun holster 100, the holster member 106 may be incorporated into the holster support member 104 or fixedly attached thereto. In preferred embodiments of the invention, the holster member 106 is removable and may be interchanged with a selection of holster members 106 each designed to hold various models of firearm.

In a preferred embodiment of the mattress mount gun holster 100, the holster member 106 is attached to the holster support member 104 by means of hook and loop attachment, with one or more areas of attachment provided on the second side of the holster support member 104 and on a first side of the holster member 106. In the embodiment shown in the Figures, two hook and loop fasteners 116 are provided to attach the holster member to the holster support member, one above and one below the slots 110. The holster member 106 may be attached to the holster support member 104 so that it overlaps the tabs 108 and provides additional support to retain the tabs 108 in slots 110, although in some uses the holster member 106 need not contact tabs 108.

Other forms of releasable attachment may be utilized to attach the holster member 106 to the holster support member 104, such as clips, belts, quick release or quarter turn fasteners, or Dzus fasteners. In some embodiments of the mattress mount gun holster, the holster support member 104 may be configured to accept and support a variety of holsters known in the art for releaseably attaching to straps, belts, or by other means.

In a preferred embodiment, the holster member 106 comprises a plate 112 with a first side for attaching to the holster support member 104, and a holster receiver 114 attached to the second side of plate 112 for receiving and holding a firearm against plate 112. The holster receiver 114 may be formed unitarily with plate 112 in some embodiments of the invention.

Referring now to FIG. 2, the mattress mount gun holster 100 is shown in a disassembled, exploded view. Mattress insert 102 is shown removed from holster support member 104, and holster member 106 has been removed and rotated by 90 degrees around two axis. The fasteners 116 can be seen more clearly to provide a variety of positions to which holster member 106 may be attached at a variety of angles and locations on the support member 104. In the embodiment shown in FIG. 2, holster support member is provided with two slots 110 to match the two tabs 108 on mattress insert 102, however a different number of tabs and slots may be provided on other embodiments of the holster 100.

Figure 3:
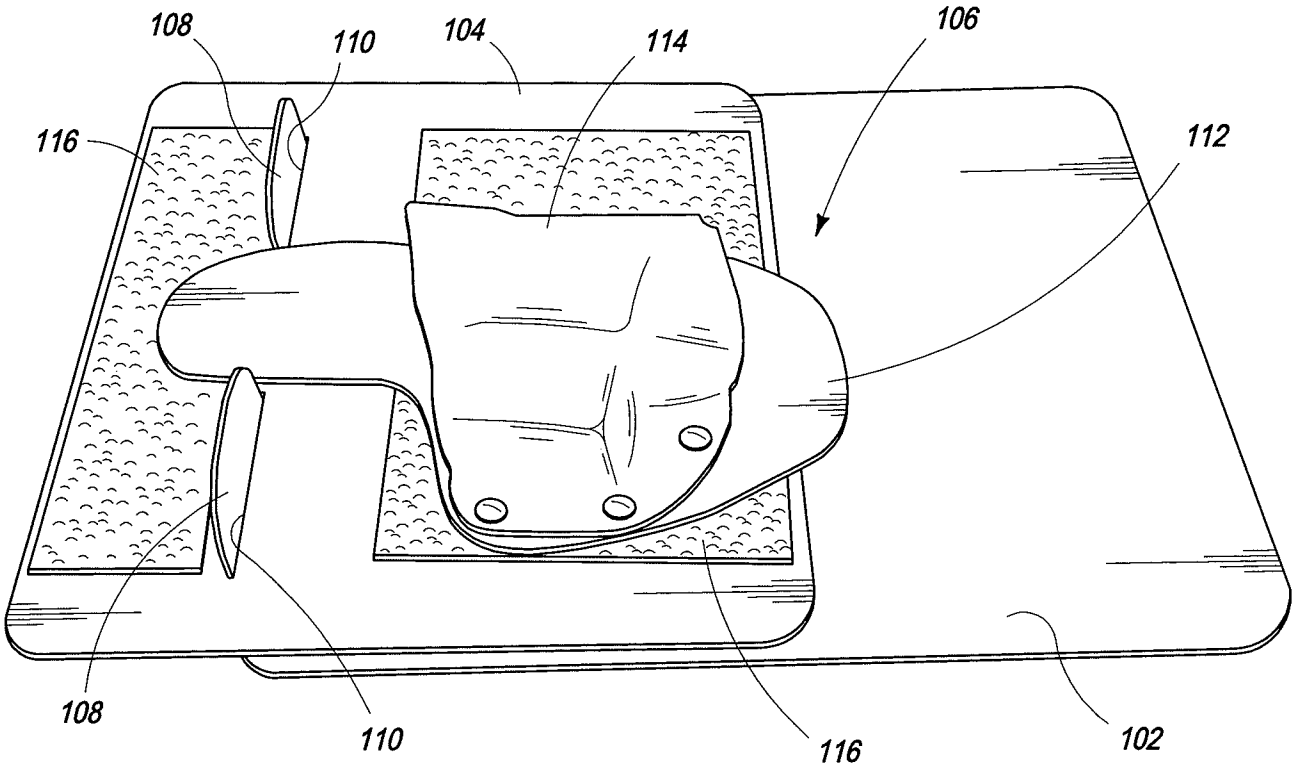
FIG. 3 is a view of an embodiment of the mattress mount gun holster in a folded configuration.

Referring now to FIG. 3, the mattress mount gun holster 100 is depicted in a flat configuration suitable for storage during periods of non-use or for purposes of travel. The mattress insert member 102 is flat and adjacent to holster support member 104. In the depiction in the figures, tabs 108 extend through slots 110, however a user may elect to completely remove the two components from one another and pack separately, or they may be packed adjacent but without the tabs 108 extending through the slots 110, but instead adjacent to an edge of the support member 104. Similarly, the holster 106 is shown fastened to fasteners 116 in the flat configuration, however it may be altogether removed when in the flat configuration or attached to the support member 104 in a different orientation or configuration than that shown in the figures.

Figure 4:
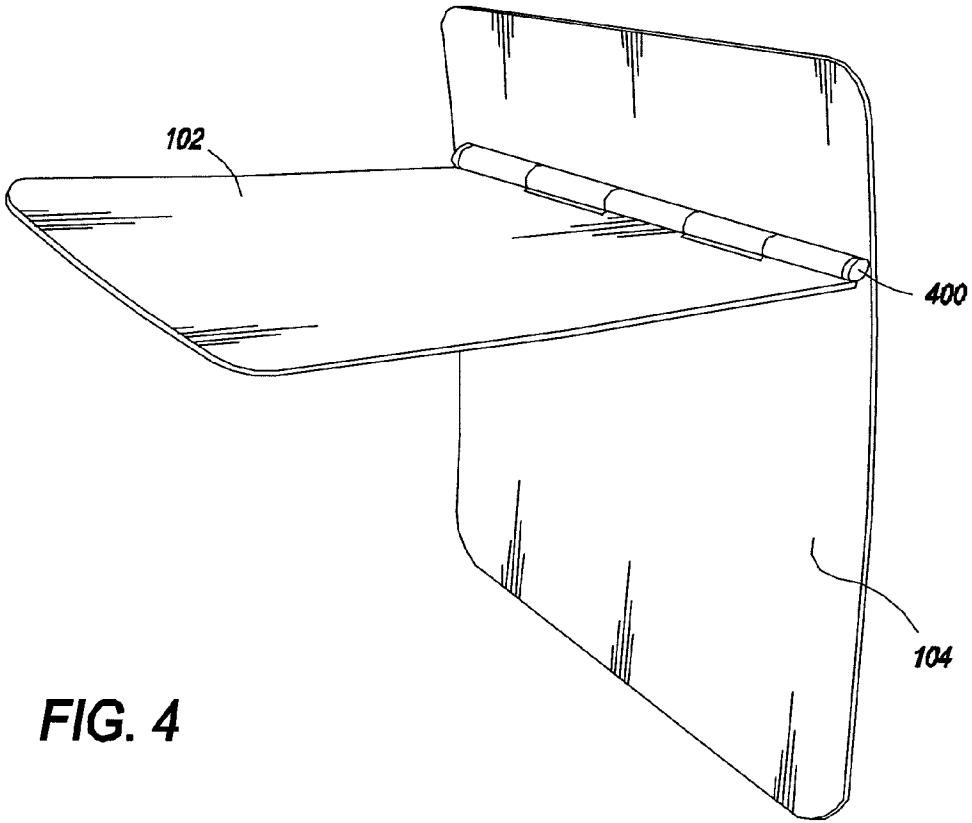
FIG. 4 is a perspective view of an embodiment of the mattress mount gun holder.

Referring now to FIG. 4, an alternative embodiment of the mattress mount gun holster 100 is depicted. In this embodiment of the holster 100, the mattress insert 102 is rotatably attached to the holster support by a hinge 400. The hinge 400 allows the mattress insert 102 to be folded flat against holster support 106. The holster member 106 releasably attaches to the other side of the holster support member 104 as in other embodiments of the holster 100.

Figure 5:
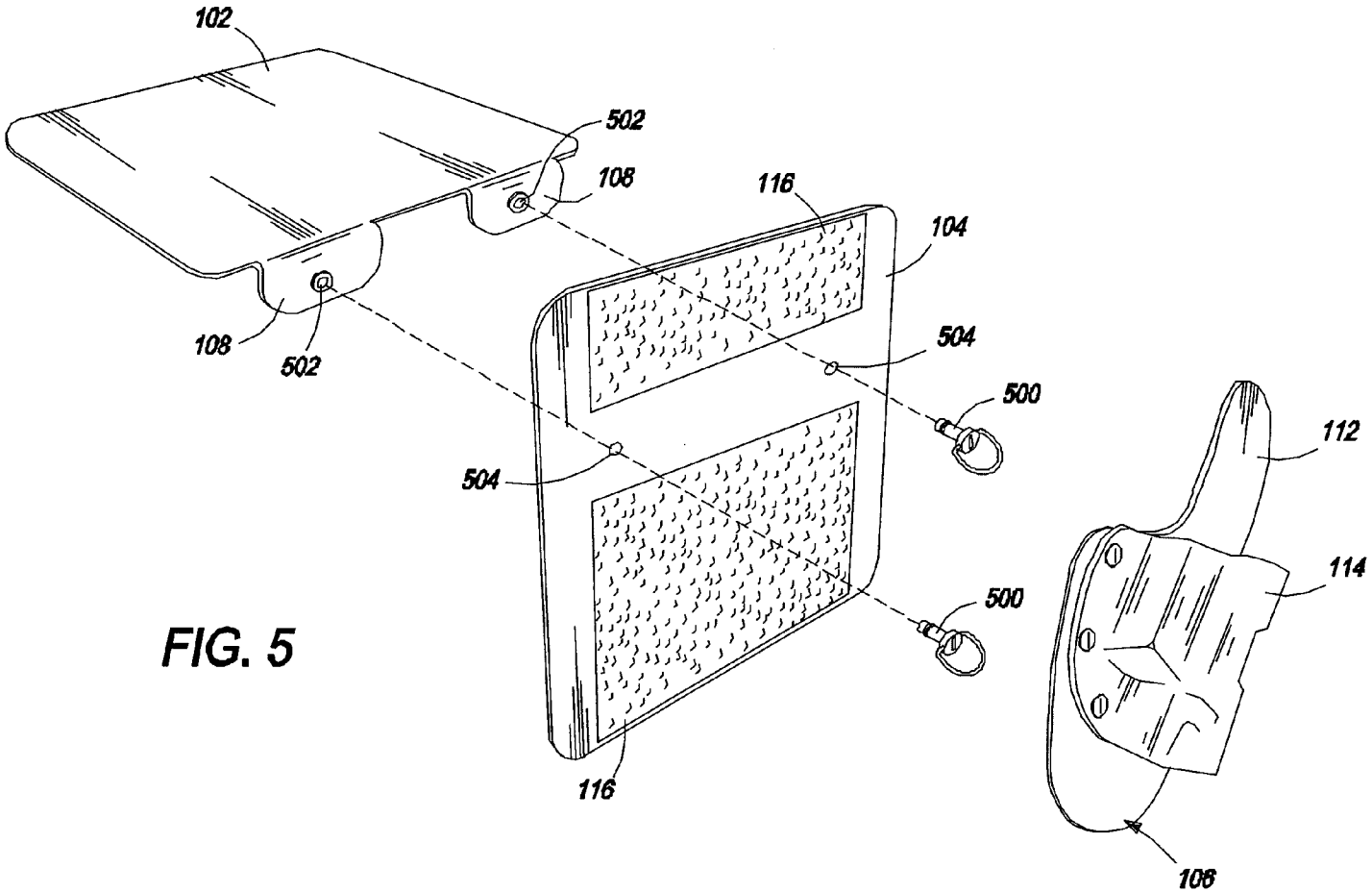
FIG. 5 is an exploded view of an embodiment of the mattress mount gun holder.

Referring now to FIG. 5, another alternative embodiment of the mattress mount gun holster 100 is depicted. In this embodiment, mattress mount 102 is secured to holster support 104 by quick release fasteners 500. The quick release fasteners 500 may be of various kinds of quarter turn fasteners, dzus fasteners, or other types of quick release fasteners. In the embodiment shown in FIG. 5, fasteners 500 fasten to receptacles 502 in tabs 108 after passing through holes 504. In various embodiments of the holster 100 there may be more than two fasteners 500 in more or less than two tabs 108 on mattress insert 102.

Figure 6:
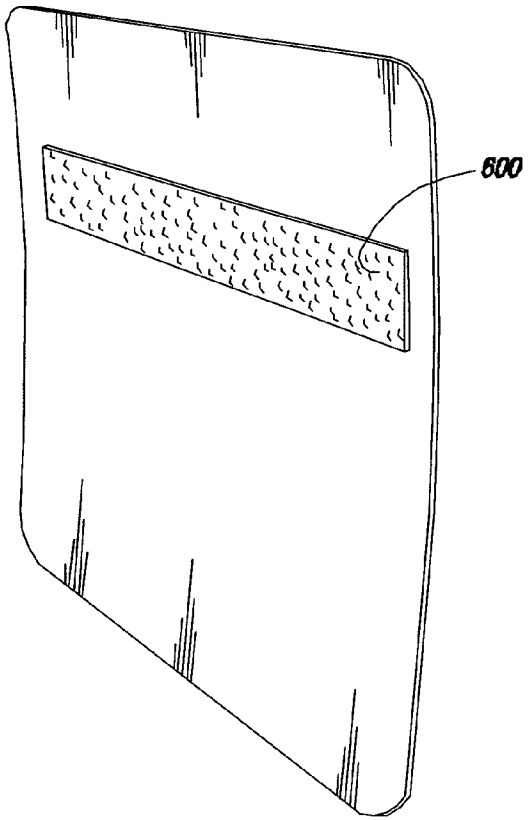
FIG. 6 is an exploded view of an embodiment of the mattress mount gun holder.
Figure 6:
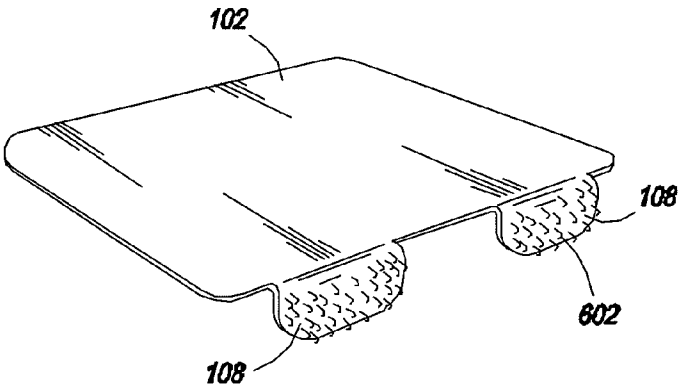

Referring now to FIG. 6, another embodiment of the holster 100 is depicted. In the embodiment shown therein, mattress insert 102 is releasably attached to holster support member 600 by hook and loop type fasteners 600 and 602. The tabs 108 may be more than two in number, or may be a single longer tab 108 running substantially the width of mattress insert 102.

Many different arrangements of the various components depicted, as well as components not shown, are possible without departing from the spirit and scope of the present invention. Embodiments of the present invention have been described with the intent to be illustrative rather than restrictive. Alternative embodiments will become apparent to those skilled in the art that do not depart from its scope. A skilled artisan may develop alternative means of implementing the aforementioned improvements without departing from the scope of the present invention.

What is claimed is:

1. A mattress mount gun holster comprising a mattress insert member, a holster support member and a holster member, wherein the mattress insert member is pivotally attached along a first edge thereof to a first side of the holster support member, and the holster member is attached to the second side of the holster support member; and wherein the holster support member may be disposed substantially perpendicular to the mattress insert member in an open configuration or stored adjacent to the mattress insert member in a folded configuration; and wherein the mattress insert member comprises a rigid plate with a top surface and a bottom surface, and a first edge with a plurality of rigid tabs disposed on the first edge of the rigid plate, wherein the rigid tabs extend in a direction perpendicular to the bottom surface of the rigid plate and do not extend toward or above the top surface of the rigid plate; and wherein the holster support member comprises a rigid plate with a plurality of slots disposed through the rigid plate and extending from the first side of the holster support member to the second side of the holster support member, the slots disposed to accept the rigid tabs on the first edge of the mattress insert member; and wherein the holster support member may be rotated from the open configuration to the folded configuration without removing the rigid tabs from the slots.

2. The mattress mount gun holster of claim 1 wherein the holster member is releaseably attached to the holster support member by hook and loop fasteners.

* * * * *